US007578695B2

(12) United States Patent
Boeck et al.

(10) Patent No.: US 7,578,695 B2
(45) Date of Patent: Aug. 25, 2009

(54) PLUG CONNECTOR WITH IMPROVED CABLE STRAIN RELIEF

(75) Inventors: Werner Boeck, Gross-Umstadt (DE); Ralf Schmidt, Fuerth (DE); Martin Szelag, Bickenbach (DE)

(73) Assignee: Tyco Electronics AmP GmbH, Bensheim (DE)

( * ) Notice: Subject to any disclaimer, the term of this patent is extended or adjusted under 35 U.S.C. 154(b) by 13 days.

(21) Appl. No.: 11/873,214

(22) Filed: Oct. 16, 2007

(65) Prior Publication Data

US 2008/0096417 A1 Apr. 24, 2008

(30) Foreign Application Priority Data

Oct. 20, 2006 (DE) ..... 10 2006 049 563

(51) Int. Cl.
*H01R 13/58* (2006.01)

(52) U.S. Cl. ..... 439/463; 439/460

(58) Field of Classification Search ..... 439/460, 439/463, 469, 470

See application file for complete search history.

(56) References Cited

U.S. PATENT DOCUMENTS

| | | | | |
|---|---|---|---|---|
| 6,935,884 | B1 | 8/2005 | Perkin | |
| 7,112,086 | B1 * | 9/2006 | Wu | 439/460 |
| 7,255,587 | B2 | 8/2007 | Boeck et al. | |

FOREIGN PATENT DOCUMENTS

| | | | |
|---|---|---|---|
| DE | 19829486 | C1 | 11/1999 |
| DE | 102004038123 | A1 | 2/2006 |
| DE | 202006007170 | U1 | 11/2006 |
| GB | 2261775 | A | 5/1993 |

* cited by examiner

*Primary Examiner*—Khiem Nguyen
(74) *Attorney, Agent, or Firm*—Barley Snyder LLC

(57) ABSTRACT

The invention relates to a plug connector with a housing for accepting an electrical cable with at least an electric wire and a sheathing. On the housing, a holding element is fixed that has a holding tab, the holding tab being arranged at an angle to a longitudinal direction of the electrical cable, and an edge of the holding tab being provided for engaging the sheathing of the cable.

18 Claims, 9 Drawing Sheets

PLUG CONNECTOR WITH IMPROVED CABLE STRAIN RELIEF

CROSS-REFERENCE TO RELATED APPLICATION DATA

This application claims the benefit of the earlier filed parent patent application document DE 10 2006 049 563.2 having a filing date of Oct. 20, 2006.

FIELD OF THE INVENTION

The invention relates to an electrical plug connector with an improved cable strain relief.

BACKGROUND

A plurality of electrical plugs and electrical plug receptacles or sockets which accept plugs are known. They differ in the number, shape, size, arrangement of the contacts and shielding against electromagnetic interference (EMI).

The plug connectors have electrical contacts for electrical connection to electric wires of an electrical cable. Moreover, for the production of a robust plug connector, the electrical cable must be fixed to the plug connector by a strain relief. The strain relief ensures that tensile force acting on the cable is at least partly compensated and is not transferred to the electrical connections of the electric wires in the plug connector.

A cable strain relief is required in particular when used in a motor vehicle.

From DE 10 2004 038 123 A1 a generic electrical plug connector is known wherein holding means are constructed on the housing of the plug connector in the form of pins.

SUMMARY

The plug connector according to the invention has a holding element for holding the electric wire being formed of a separate component that is fixed on the housing of the plug connector. The holding element has a holding tab that is arranged at an angle to a longitudinal direction of the mounted electrical cable. The holding tab has an edge for engaging the sheathing of the electrical cable. In this way a simple and reliable cable strain relief is made available on the housing of the plug connector.

BRIEF DESCRIPTION OF THE DRAWINGS

Embodiments of the invention are explained in more detail based on the figures of which.

DETAILED DESCRIPTION OF THE EMBODIMENTS

Figure 1:
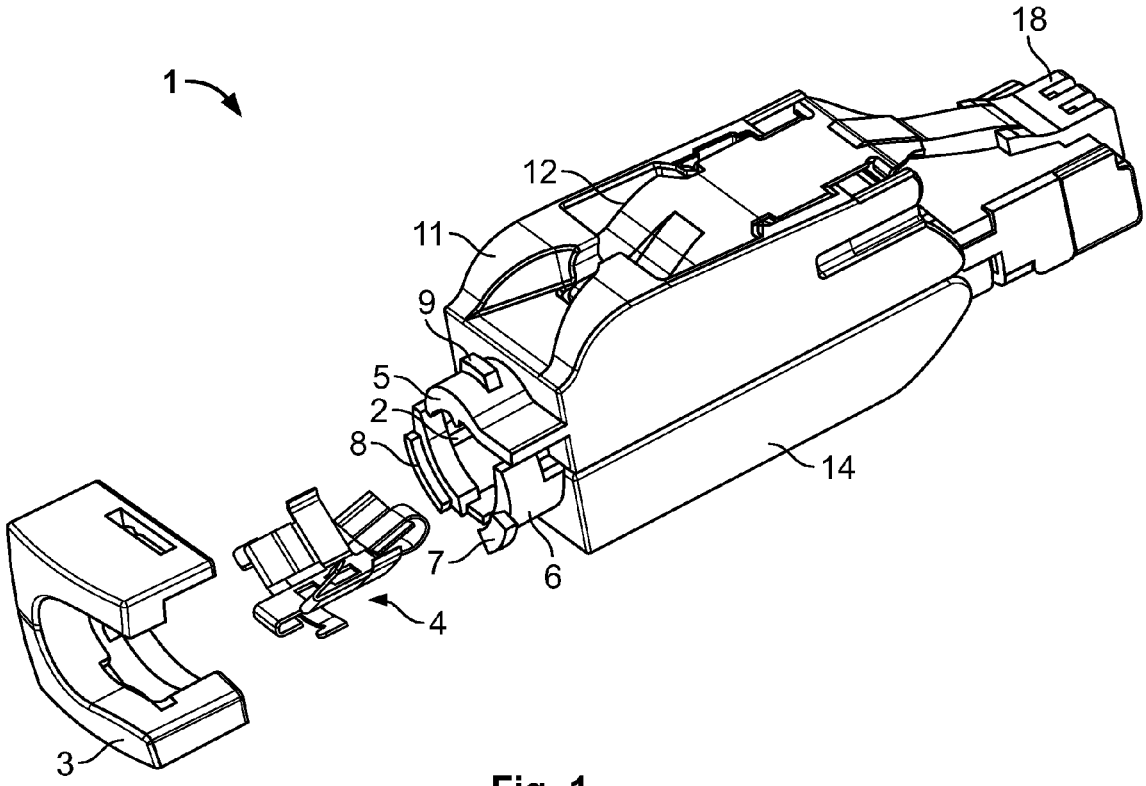
FIG. 1 is an exploded view of the plug connector with a holding element and a locking piece.

FIG. 1 shows in a schematic perspective representation essential components of a plug connector 1 that has a housing 11 with first and a second housing parts 12, 14, a plug contact area 18, and a cable opening 2 arranged opposite the plug contact area 18. Furthermore, a locking piece 3 and a holding element 4 are shown.

The first housing part 12 has a shell-shaped first holder 5 for holding and guiding the locking piece 3. A second holder 6 of the second housing part 14 is assigned to the first holder 5. On the first and the second holder 5, 6, guide bars 7, 8, 9 are provided for holding and guiding the locking piece 3.

In the assembled state, the locking piece 3 is fixed either on the first or on the second housing part 12, 14 so that it can rotate. In the assembled state, the holding element 4 is fixed in the first or in the second housing part 12, 14.

Figure 2:
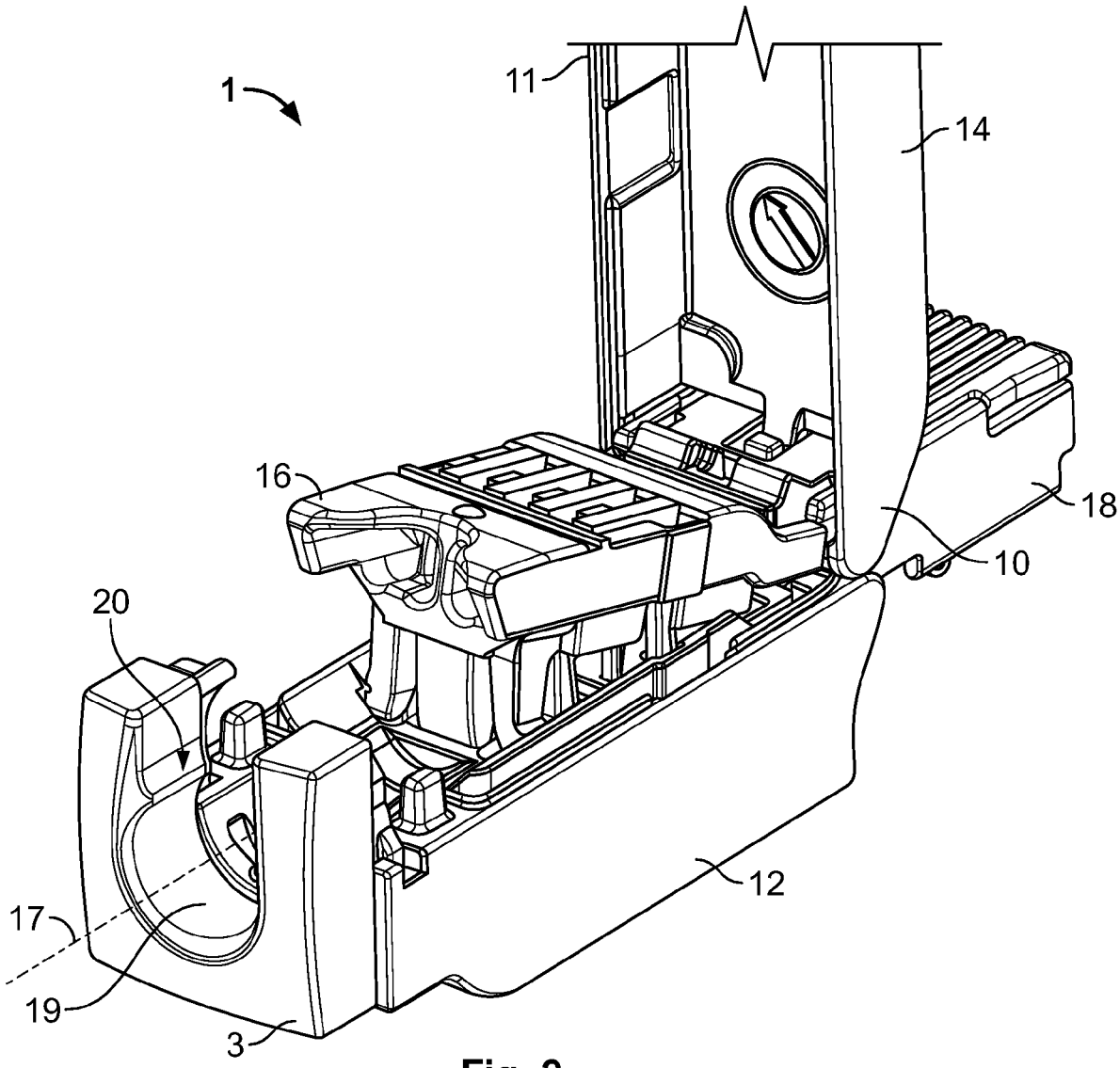
FIG. 2 shows a plug connector in the opened state before the insertion and contacting of a cable.

FIG. 2 shows the plug connector 1, wherein the second housing part 14 is swiveled upwards on an axis of rotation 10 within an interior space of the housing 11 with a cable end recess 16 being accessible. The cable end recess 16 is constructed as a swivel part that can swivel around the axis of rotation 10. The cable end recess 16 has a plurality of channels into which electric wires of a cable can be inserted. Electrical contacts are located in the channels, for electrically contacting the electric wires of the cable. The electrical contacts are guided in the housing up to the plug contact area 18 and are constructed as plug contacts. The plug contact area 18 is connected rigidly to the first housing part 12. In the embodiment shown, the locking piece 3 is pivoted on the first holder 5 of the first housing part 12. The locking piece 3 has a substantially U shape, and a second cable opening 19 that is circular in cross section is provided. The second cable opening 19 is oriented symmetrically to the first cable opening 2. The locking piece 3 can rotate around a central axis 17 of the first cable opening 2, which is likewise circular in cross section. The locking piece 3 has a lateral opening 20 through which a cable can be inserted into the first cable opening 2, 19.

Figure 3:
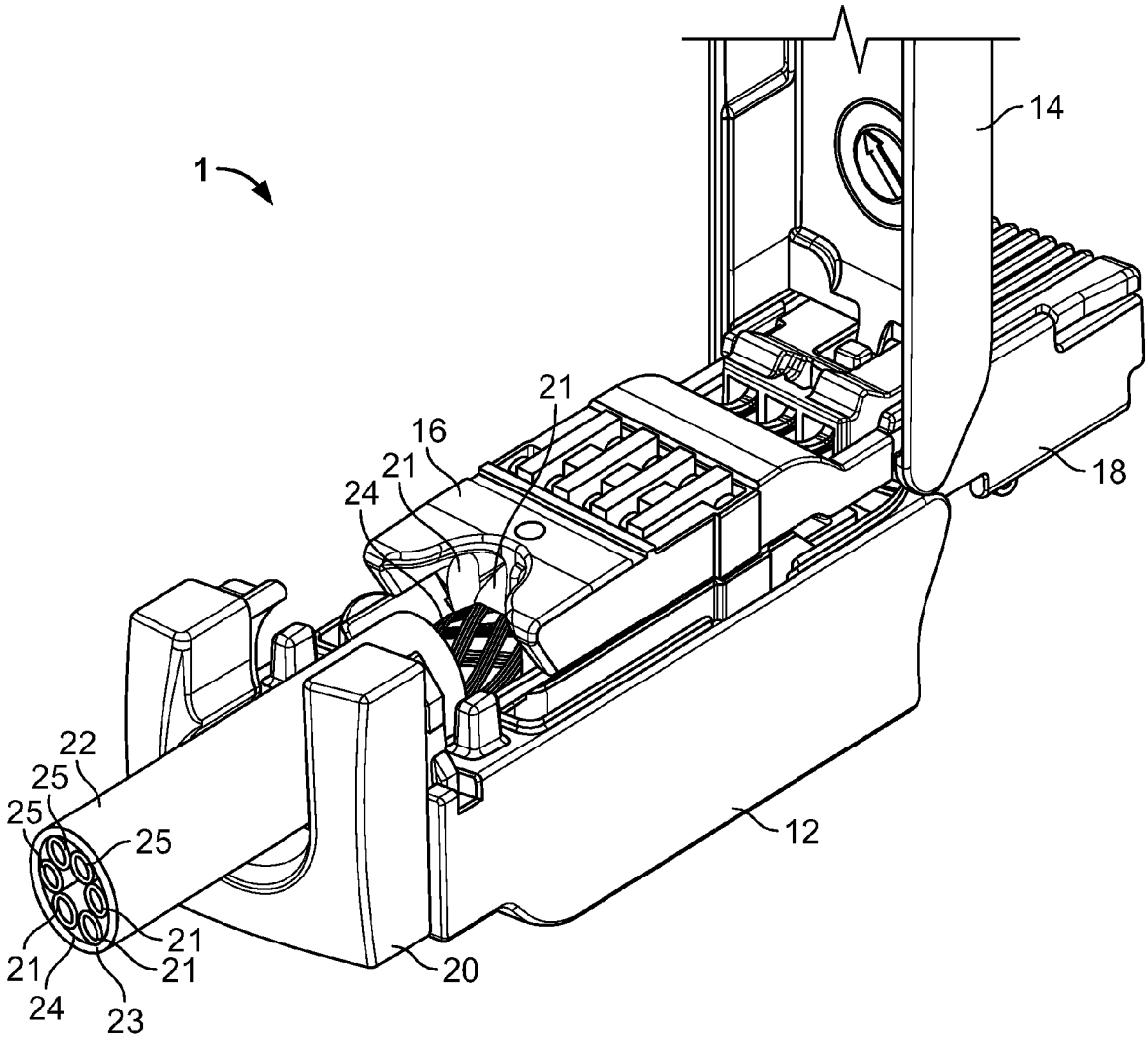
FIG. 3 shows a plug connector with inserted and contacted cable.

FIG. 3 shows the plug connector 1, wherein a cable 22 is inserted into the cable opening 2 and electric wires 21 of the cable 22 are guided in channels of the cable end recess 16 and are connected to electrical contacts of the plug contact area 18 so as to be electrically conductive. In this position the cable end recess 16 is again swiveled downwards into a locking position. The wires 21 are exposed in an end area of the cable 22 and are guided into the channels of the cable end recess 16. Furthermore an electrical shield 24 of the cable 22 is exposed.

The cable 22 has an electrically insulating sheathing 23, under which the shield 24 is arranged. The shield 24 surrounds a bundle of electric wires 21, which are respectively enveloped in an insulating layer 25.

By swiveling the cable end recess 16 towards the first housing part 12, the electrical wires 21 are brought into electrical contact with the plug contacts of the plug contact area 18. This is performed for example by clamp contacts or cutting contacts that are connected firmly to the first housing part 12 and that cut through the insulating layers 25 of the electric wires 21 and contact the electric wires 21. Alternatively crimp contacts or piercing contacts can be used.

The exposed shield 24 of the cable 22 is contacted when the cable end recess 16 is swiveled down to the first housing part 6 in contact with a contact face, not shown, of the holding element. The contact face is electrically connected to a housing shield (not shown) of the first and the second housing part 12, 14. Depending on the embodiment used, the first and the second housing part 12, 14 can be made of plastic material and can have metal layers or inlays that shield the plug connector 10 against electromagnetic interference. Depending on the embodiment selected, the first and the second housing part 12, 14 can be produced from metal, for example as a die-cast part, in order to achieve particularly good shielding and a high mechanical robustness. In this embodiment the electrical plug contacts are integrated in a plastic material component, so that the electrical plug contacts are electrically insulated from the first and the second housing part 12, 14.

Figure 4:
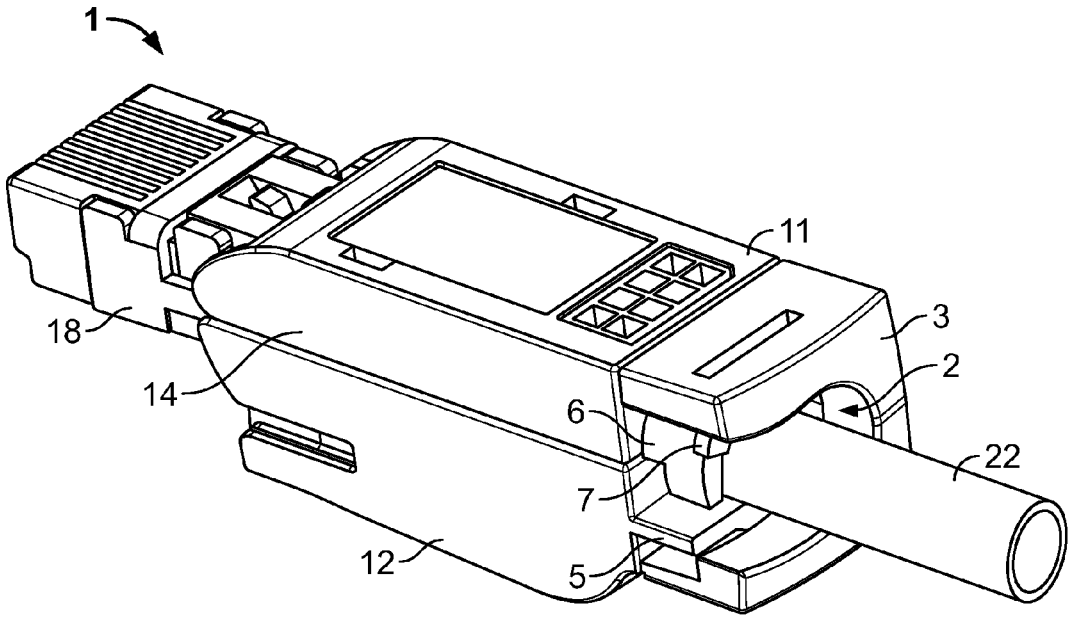
FIG. 4 shows a locked plug connector, wherein the locking piece is in the locking position.

FIG. 4 shows the plug connector 1 with a closed second housing part 14, into which the cable 22, as explained with regard to FIG. 3, is fixed in the plug connector 1 and the locking piece 3 is rotated from the assembly position of FIG. 3 into the locking position. The locking piece 3 holds the first and the second housing parts 12, 14 together in the locking position, in that the locking piece 3 embraces both the first and the second holder 5, 6. In the locking position, the locking piece 3 is engaged.

Figure 5:
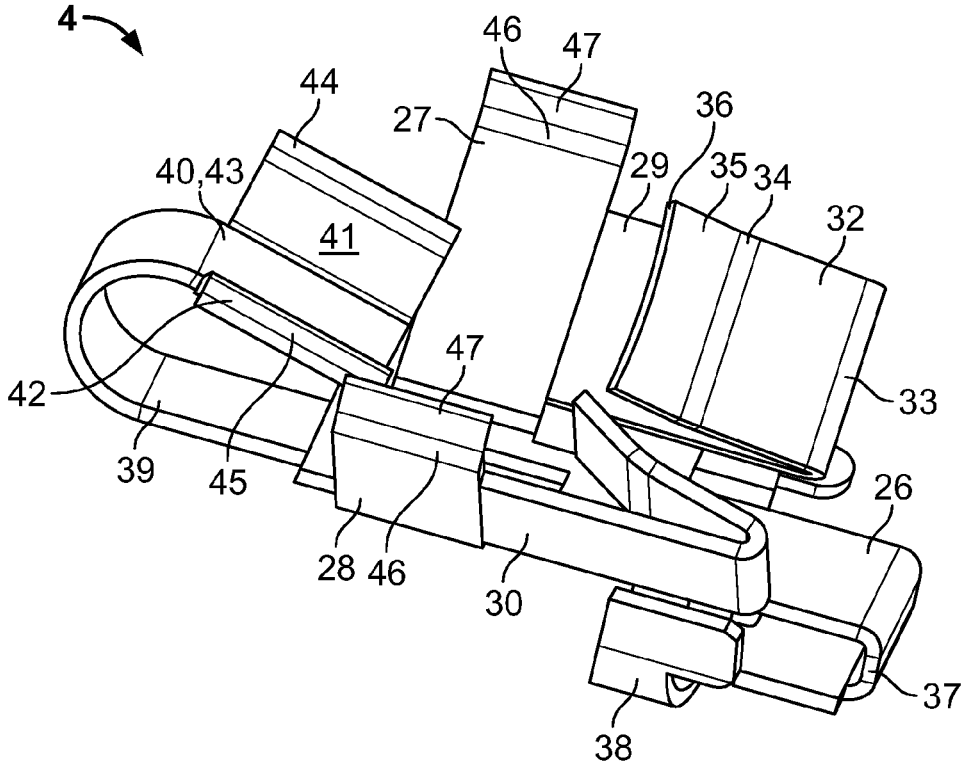
FIG. 5 shows a first view of the holding element.

FIG. 5 shows an enlarged perspective representation of the holding element 4. The holding element 4 has a rectangular flat basic element 26 from which, on opposite longitudinal sides, first and second holding arms 27, 28 extend outward. The first and the second holding arm 27, 28 each have a substantially rectangular shape, wherein on a first lateral face, a first or a second spring arm 29, 30 extends outward. The first and the second spring arm 29, 30 are oriented substantially in the longitudinal direction of the basic element 26 and have a first and a second portion 31, 32. The first portion 31 is oriented substantially in the direction of the basic element 26 and merges with the second portion 32 via a bent portion 33. Starting from the bent portion 33, the second portion 32 extends back in the direction of the first holding arm 27. The bent portion 33 has a bend angle of more than 90°, for example, 140°. The second portion 32 extends to a third portion 35 via a deflection area 34. The third portion 35 is arranged away from the first spring arm 29 at a predetermined angle to the second portion 32. The angle is between 178° and 100°, for example, 160°. The third portion 35 has an edge 36 that is provided for the jamming into or for the pressing with positive engagement into the sheathing 23 of the cable 22. The edge 36 is arranged tangentially to a receptacle space for the cable 22.

The second holding arm 28 is constructed identically to the first holding arm 27. The first and second holding arms 27, 28 are arranged at an angle smaller than 180° relative to a face of the basic element 26. In cross section the first and the second holding arm 27, 28 are formed in approximately a V shape.

In a simple embodiment, the edge 36 is already constructed on the second portion 32, and the deflection portion 34 and the third portion 35 are omitted. Through the embodiment of the third portion 35 and the deflection portion 34, an improved jamming into or an improved pressing of the edge 36 into the sheathing 23 of the cable 22 is achieved.

In a simple embodiment, only one spring arm 29 with a first and a second portion 31, 32 is provided with a bent portion 33. In the embodiment shown, an improved jamming into or an improved pressing of the edge 36 into the sheathing 23 of the cable 22 is achieved by means of the formation of the two spring arms 29, 30 with the respective first and second portion 31, 32 with the bent portion 33, the deflection portion 34 and the third portion 35 with the edge 36. The first and second spring arm 29, 30 with the first, second, and optionally the third portion 31, 32, 35 represent a first or second holding tab. The first and second holding tab can also be constructed directly on the basic element 26 without a first and second spring arm. The first and second tabs are flexibly mounted on the holding element.

The basic element 26 is connected at a first end to a guiding part 38 via a bent portion 37. At the opposite second end of the basic element 26, a third spring arm 39 is constructed in the form of a further bent portion that is guided upwards and back in the direction of the basic element 26. The third spring arm 39 is provided with a contact face 40 that is arranged at an angle smaller than 90° to the surface of the basic element 26 and extends almost to the area of the first and the second holding arm 27, 28 and is arranged at least partially above the basic element 26. The contact face 40 has two contact wings 41, 42 that extend outwards on opposite sides of a base face 43 of the contact face 40. In this way a contact face with three mating surfaces is made available. Depending on the embodiment used, lateral locking edges 44, 45 of the contact wings 41, 42 can be bent outwards.

In a further embodiment, the first and the second holding arms 27, 28 can turn into an end portion 47 via a further bent portion 46. The end portion is arranged angled inwards in the direction of the basic element 26, and preferably perpendicular to the basic element 26.

The holding element 4 is preferably formed from metal and is produced from a metal plate or metal foil with the aid of a stamping and forming process. A basic shape can be developed thereby from a metal plate or metal foil with the aid of a stamping process or a laser cutting process. The holding element described in FIG. 4 is produced by subsequent forming and bending processes.

The contact face 40 represents a resiliently mounted contact face that exerts a permanent pressure on the shield 24 of the cable 22 and thus causes a secure electrical contact to the shield 24. In the assembled state, the holding element 4 is connected to an electrically conductive shielding face of the plug connector 1 or at least to an electrically conductive contact.

The first and second spring arms 29, 30 with the first and second portions 31, 32, the bent portion 33, the deflection portion 34 and the third portion 35 with the edge 36 represent resiliently mounted strain relief elements in the form of holding tabs. The second portion 32 serves as a mating surface to the surface of the sheathing 23 and thus limits the penetration depth of the third portion 35. The penetration depth is determined by the angle between the second and the third portion 32, 35 and the length of the third portion 35.

Through the angled or V-shaped arrangement of the first and the second holding arm 27, 28 the holding tabs are arranged displaced at an angle around the circular circumference of the sheathing 23. In this way, an improved clamping or jamming or penetration of the holding tabs into the sheathing 23 is achieved.

Figure 6:
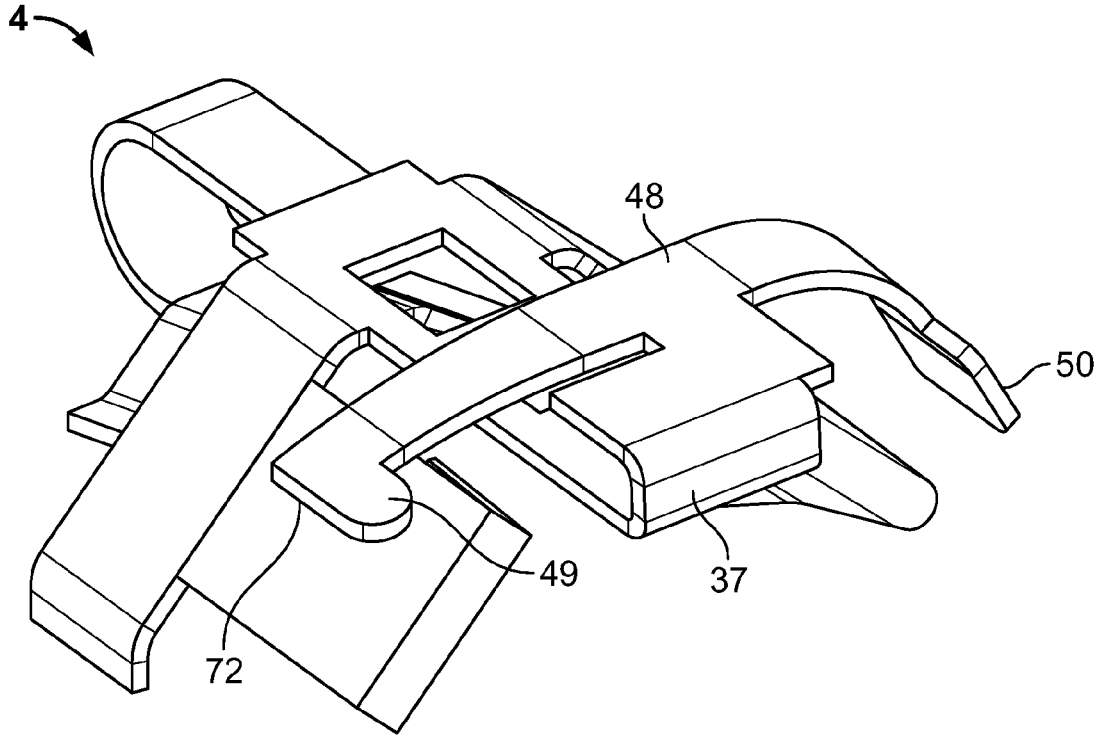
FIG. 6 shows a second view of the holding element.

FIG. 6 shows the holding element 4 with a view of the guiding part 38. The guiding part 38 is flexibly mounted on the bent portion 37 and extends in the form of an elongated strip transverse to the longitudinal direction of the basic element 26. The strip 48 has a first or second catch projection 49, 50 on opposite ends. The strip 48 is arranged substantially perpendicular to the longitudinal direction of the basic element 26 and at a distance from the basic element 26 in a partial arch. The first or second catch projections 49, 50 serve to engage with catch edges or catch recesses of the locking piece 3. In addition, the first or second catch projections 49, 50 can determine a starting rotation position or an end rotation position of the locking piece 3. Furthermore the first or second catch projection 49, 50 can be used as a pressure element or guiding element to produce the play compensation and improved concentricity between the locking piece 3 and the first and second housing part 12, 14. The strip 48 is preferably constructed in cross section as a partial circle and serves to guide the locking piece 3 or to ensure the locking of the locking piece 3 on the housing 11.

Figure 7:
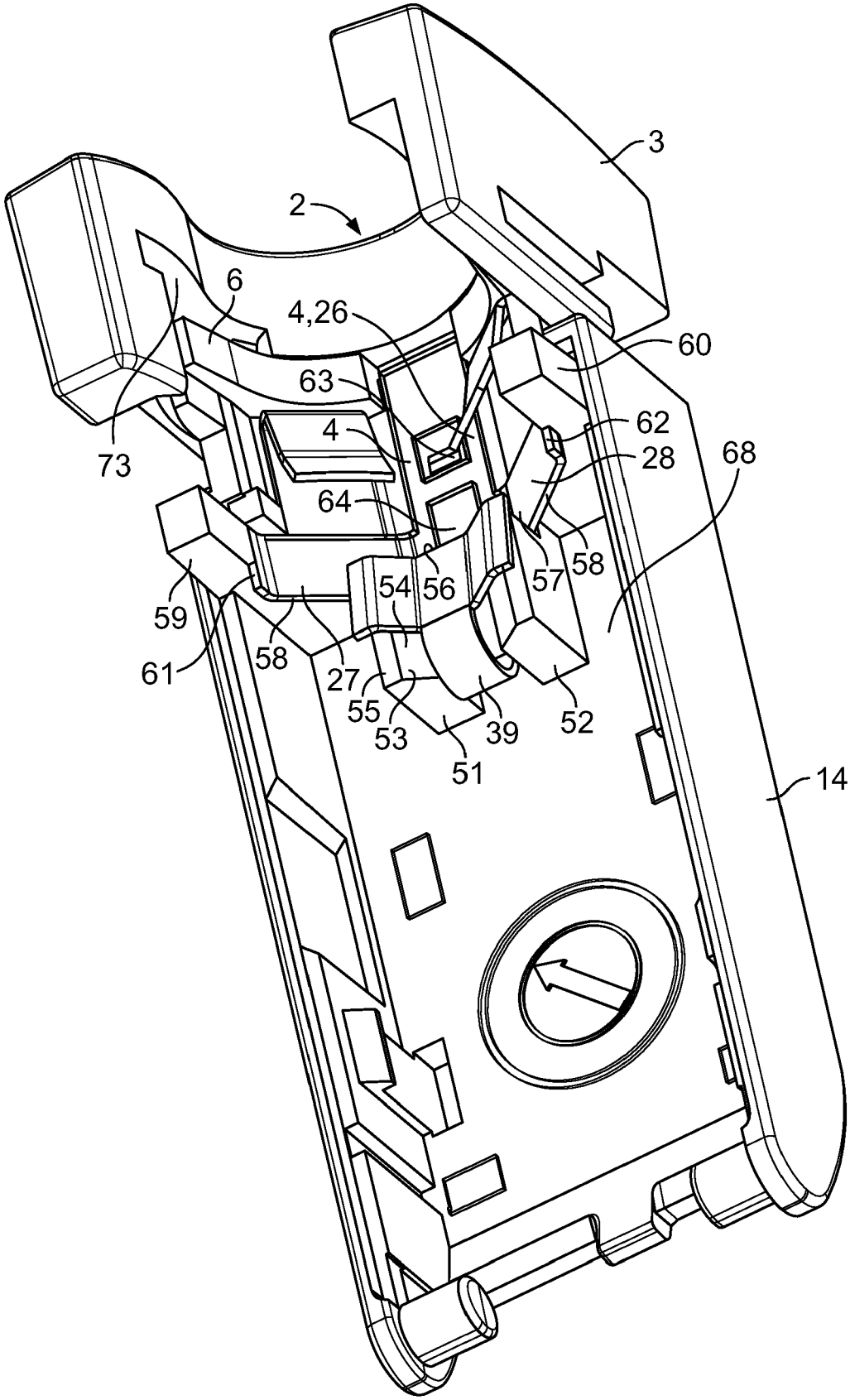
FIG. 7 shows a view of an underside of a second housing part with holding element and locking piece.

FIG. 7 shows a perspective representation of an embodiment in which the holding element 4 and the locking piece 3 are fixed on the second housing part 14. During the assembly, the locking piece 3 is fitted on the holder 5 of the second housing part, wherein a part of the holder 5 is accepted by a recess 73 of the locking piece. Then the locking piece is rotated from the starting position into the assembly position, as shown. The locking piece 3 is in the assembly position, in which the cable 22 is inserted into the cable opening 2. The first housing part 12 is not shown, for the sake of clarity. In this embodiment the locking piece 3 is held on the second housing part 14 in the area of the cable opening 2 so that it can rotate. The holding element 4 is arranged with the basic element 26 in the longitudinal direction of the cable opening 2 and is fixed on the second housing part 14. In addition two holding blocks 51, 52 are provided on an underside of a cover plate 68 of the second housing part 14. The third spring arm 39 is arranged between the first and the second holding block 51, 52. The third spring arm 39 is arranged so that it can swivel freely thereby between the holding blocks 51, 52. The first and the second holding block 51, 52 each have on an upper side that is assigned to the contact face 40, a first mating surface 54 that runs slanting upwards from inside to outside, which mating surface merges with a second mating surface 55. The second mating surface 55 is arranged substantially parallel to the cover plate 68. The first and the second mating surface 54, 55 serve for mating the first or the second contact wing 41, 42 of the contact face 40. Through the embodiment of the contact wings 41, 42 and the arrangement of the first and the second mating surface 54, 55, a maximum displacement of the contact face 40 is limited. In addition the contact face 40 is arranged inclined at an angle to the upper sides 53 of the first and the second holding block 51, 52. Thus when a cable 22 is inserted and the contact face 40 is pressed onto the shielding 24, the contact face 40 is first pressed with an end area 56 onto the holding blocks 51, 52. Thus the tensioning for a further pressing-down of the contact face 40 is increased.

The first and the second holding block 51, 52 each have a mating edge 57 that is arranged substantially perpendicular to the underside of the cover plate 68 and serves for mating a second side edge 58 of the first and the second holding arm 27, 28. Thus the position of the holding element 4 is fixed in the direction of the first and second holding blocks 51, 52.

Furthermore a third and fourth holding blocks 59, 60 are provided on opposite side faces of the second housing part 14 between the first and second holding blocks 51, 52 and the locking piece 3. The third and fourth holding blocks 59, 60 each have an incline 61, 62 that are arranged substantially parallel to the underside of the cover plate 68, and engage in the end portions of the first and the second holding arm 27, 28 and tension the holding element 4 against the cover plate 68 of the second housing part 14. In this way the holding element 4 is also supported in both directions against a rotation around the longitudinal axis of the basic element 26. The holding tabs with the edges 36 project laterally displaced by a predetermined angle, for example 90°, inwards in the direction of the cable opening 2. The basic element 26, which is constructed substantially as an elongated rectangular basic element, has two openings 63, 64. The openings 63, 64 can be used for engaging or for fixing the basic element 26 to the second housing part 14. For example, the holding element 4 is placed on the underside of the cover plate 68 and adhesive is applied on the openings 63, 64 and the holding element 4 is bonded to the second housing part 14. Depending on the selected embodiment, the locking piece 3 and/or the holding element 4 can also be fixed on the first housing part 12.

Figure 8:
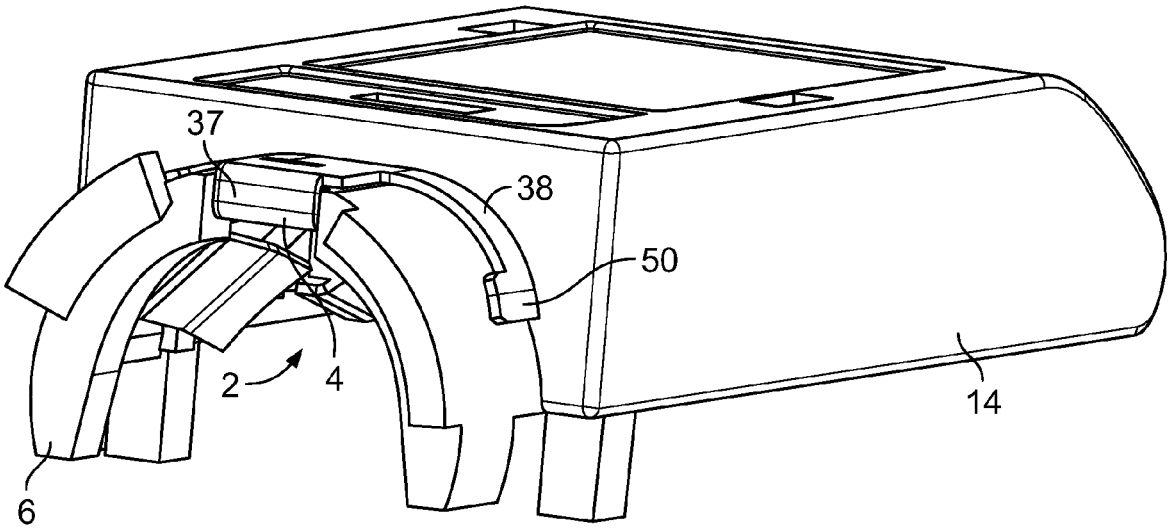
FIG. 8 is a perspective representation of the second housing part with holding element.

FIG. 8 shows the second housing part 14 with the holding element 4. The second housing part 14 has the second holder 6 in the area of the cable opening 2. The second holder 6 is constructed in the form of a shell and has contours, i.e. recesses and guiding bars for holding and guiding the locking piece 3. In addition the bent portion 37 is guided outwards from the cable opening 2 over the second holder 6. The guiding part 38 is thereby arranged outside the second holder and substantially parallel to the second holder 6, but at a distance.

Figure 9:
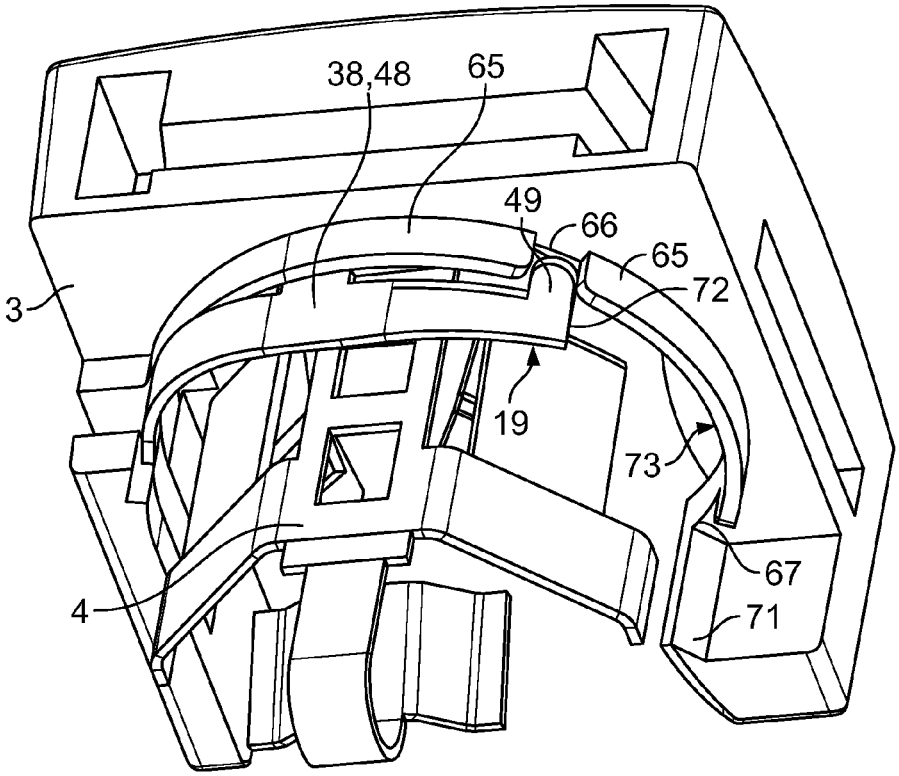
FIG. 9 is a perspective representation of the locking piece and the holding element in the open position of the locking piece.

FIG. 9 shows in a perspective representation the holding element 4 with the locking piece 3 in the assembly position, i.e. in the position of FIG. 7, in which the cable opening 2 is exposed by means of the locking piece 3 in order to push in a cable 22. In this representation it can be seen that the locking piece 3 has a border 65 in the form of a partial circle on an underside adjoining the second cable opening 19. The border 65 is constructed for example at least in the form of a semicircle. The border 65 has a catch recess 66 into which the first catch projection 49 of the guiding part 38 is engaged. The strip 48 of the guiding part 38 is thereby arranged underneath the border 65. When the locking piece 3 is now moved from the assembly position into the locking position, the first catch projection 49 is pressed from the border 65 out of the catch recess 66, which can be perceived both tactilely and acoustically. At the same time the first and/or the second catch projection 49, 50 together with the guiding part 38 can also be used as a guiding element. In this embodiment the first and/or the second catch projection 49, 50 project upwards laterally over the border 65, so that the first and/or the second catch projection 49, 50 lie at least partially on the border 65 and guide the border 65. Thereby the second catch projection 50 can be pressed outwards from the border 65. The first catch projection 49 likewise lies on an outer side of the border 65 when the first catch projection is outside the catch recess 66 and consequently also serves as a guiding element for the locking piece 3. The border 65 has a second catch recess 67, which is arranged adjacent to a stop face 71 in the end piece of a leg of the U-shaped locking piece 3. In the locking position of the locking piece 3 the first catch projection 49 engages in the second catch recess 67. The locking position of the locking piece 3 is shown in FIG. 4. The strip 48 has the form of a partial circle, the strip 48 being held on the second housing part 14 in the center of the partial circle over the bent portion 37. The first and the second catch projection 49, 50 are arranged at the opposite ends of the strip 48. The catch projections 49, 50 are connected together via the flexible strip 48, which is supported in the area of the bent portion 37 so that it can swivel.

During the assembly the locking piece 3 is fitted onto the second holder 6 in a starting position and is connected by positive engagement with the second holder 6 of the second housing part 14 via a rotary motion. During the rotary motion the stop face 71 of the locking piece 3 passes over the first catch projection 49, which is thereby, pressed inwards by the stop face 71, and springs outwards after passing over the stop face. Thus after the connection by positive engagement of the locking piece 3 with the second holder of the second housing part 14, the first catch projection 49 is arranged on the movement path of the stop face 71, viewed in the radial direction with respect to a rotation of the locking piece. Thus the first catch projection 49 limits an angle of rotation of the locking piece to an area in which a removal of the locking piece 3 from the second holder 6 by pulling is not possible. If it is attempted to rotate the locking piece 3 again into the starting position, the first catch projection 49 strikes the stop face 71 thereby before the starting position is reached. Thus the locking piece 3 is fixed securely on the second housing part 14 by the holding element 4. Only through a pressing inwards of the first catch projection 49 can the locking piece 3 be rotated into the starting position, in which the first catch projection 49 passes over the stop face 71 on the inside and the locking piece 3 can be removed from the second holder 6 after reaching the starting position.

Figure 10:
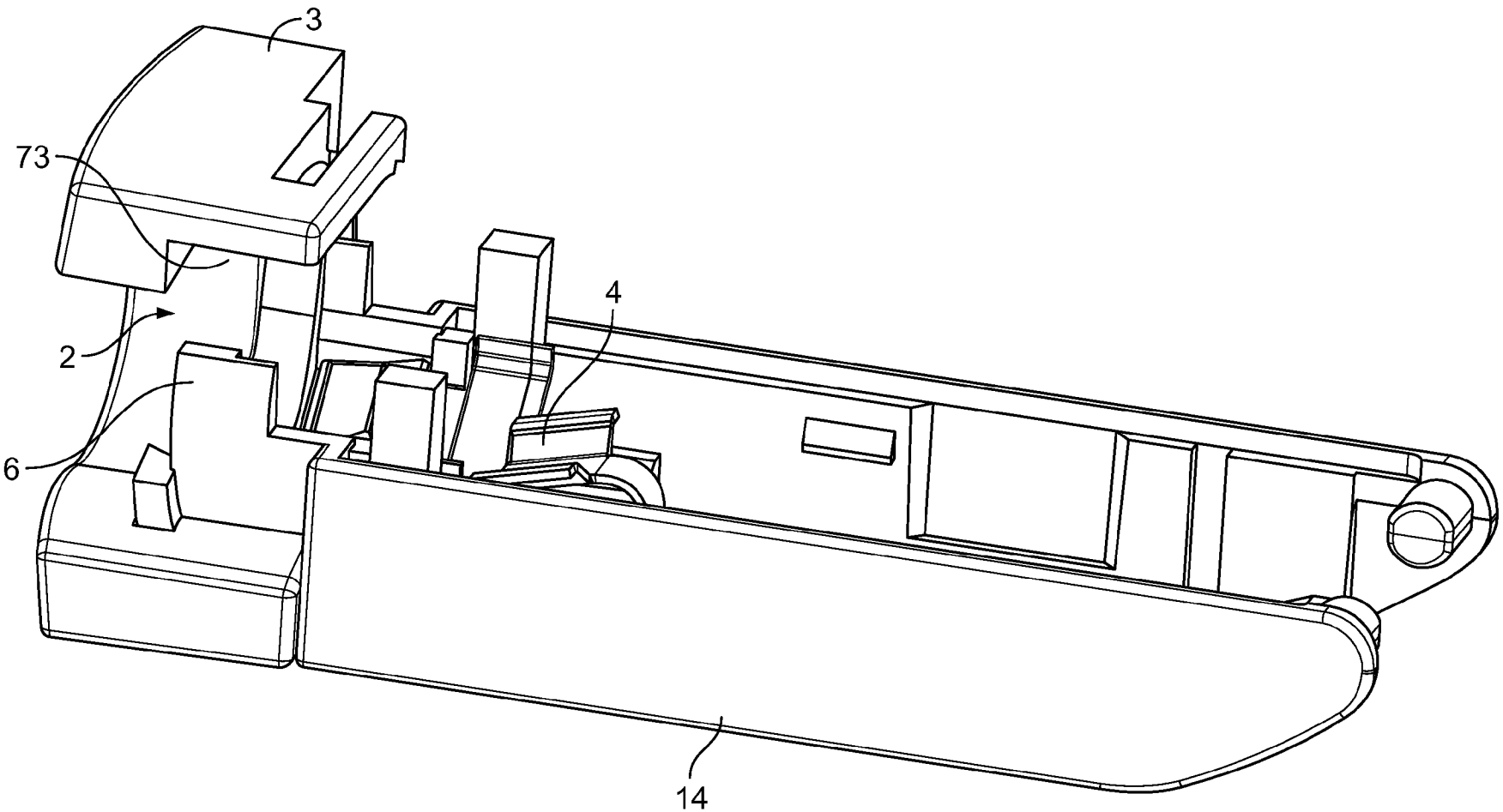
FIG. 10 is a perspective partial representation of the second housing part with the locking piece and the holding element in the locking position of the locking piece.

FIG. 10 shows the locking piece 3 with the holding element 4 and the second housing part 14 in the locking position. In the locking position a side arm of the locking piece 3 embraces the first holder 5, not shown, of the first housing part 12, not shown, and thus locks the first and the second housing part 12, 14 in the folded position.

Figure 11:
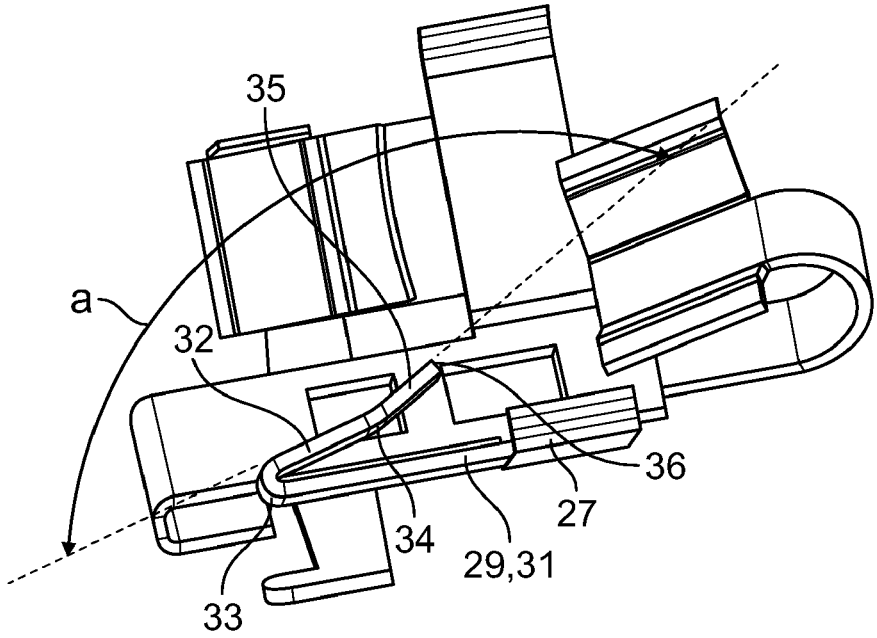
FIG. 11 is a third perspective representation of the holding element.

FIG. 11 shows a perspective view of the holding element 4, in which the angle a between the second and the third portion 32, 33 of the holding tab can clearly be seen. The angle a is thereby smaller than 180°. In addition the second and the third portion 32, 35 is arranged inclined in the direction of a central axis of the cable opening 2 or in the direction of a central axis of a cable 22.

Figure 12:
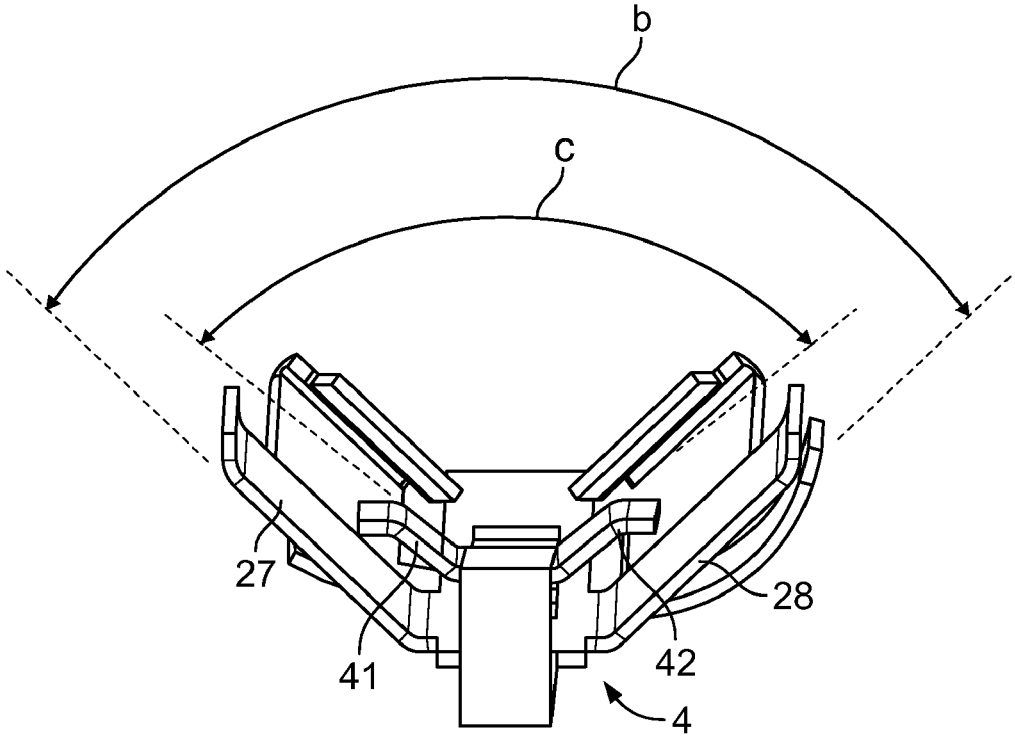
FIG. 12 is a fourth perspective representation of the holding element.

FIG. 12 shows a perspective representation of the holding element 4, the angle b between the first and the second holding arm 27, 28 being shown. The angle b can be in the range of 90°. In addition the angle c is shown, which the first and/or second contact wing 41, 42 of the contact face 40 have to one another. The angle c can likewise be in the range of 90°. An improved contacting of the shielding 24 is achieved through the V-shaped arrangement of the first and the second contact wing 41, 42.

Figure 13:
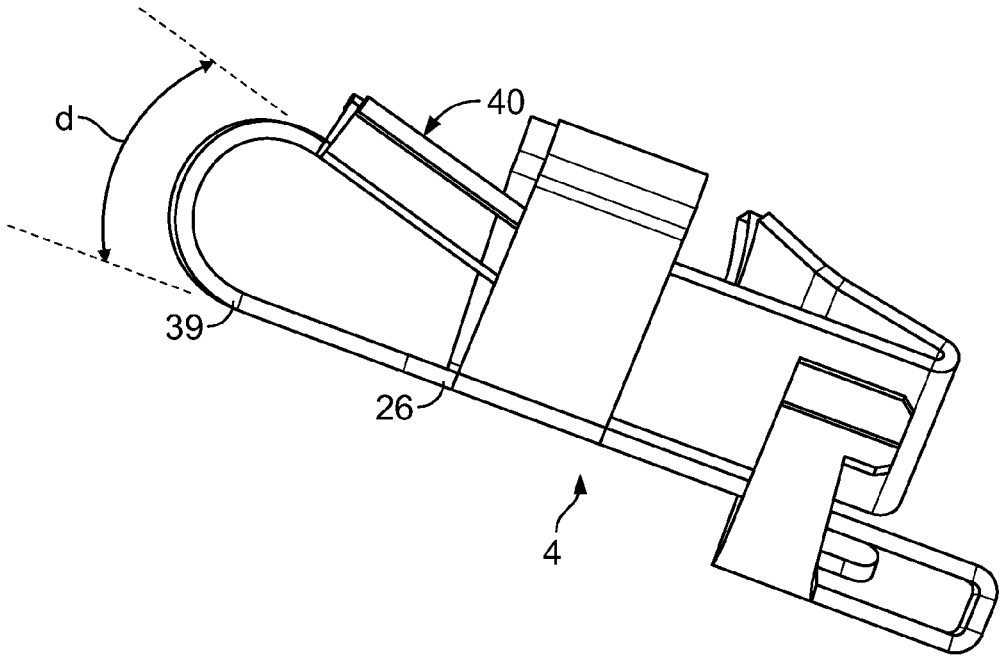
FIG. 13 is a fifth perspective representation of the holding element.

FIG. 13 shows a further perspective representation of the holding element 4, the angle d being shown between the contact face 40 and the basic element 26 and thus with a longitudinal axis of the cable opening 2 or of a cable 22. The angle d can be in the range between 2° and 90°.

Figure 14:
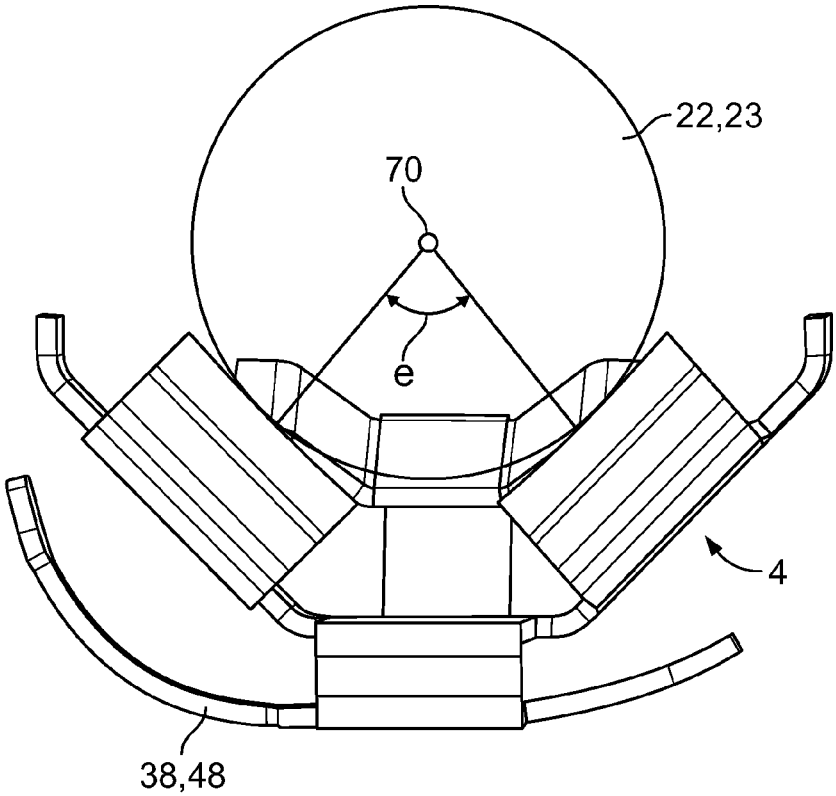
FIG. 14 is a sixth perspective representation of the holding element.

FIG. 14 shows a further perspective representation of the holding element 4 with a schematic representation of the cable 22 and its central axis 70. The first and the second holding tab with the two edges 36 are arranged at a predetermined angle e displaced around a circular circumference of the sheathing 23 of the cable 22. Due to this arrangement, the two holding tabs exert a tensioning force and clamping force on the cable 22 and clamp the cable 22 together firmly at least partially. In addition the partial arc shape of the strip 48 of the guiding part 38 can be seen in this arrangement.

A further advantage of the holder is that the holding tab is held flexibly on the housing and projects laterally into the cable opening 2. Due to the flexible holder and the arrangement, cables 22 with a different diameter can be clamped firmly by the holding tab. The cables 22 can have a smaller diameter than the cable opening 2. Due to the flexible holder of the holding tab, the holding tab is also pressed against the surface of the sheathing of the cable 22 even with a cable with a smaller diameter than the diameter of the cable opening, and the holding edge penetrates into the sheathing of the cable with positive engagement and holds the cable firmly on the housing as a strain relief. In addition, a plurality of cables can also be held firmly on the housing with at least one, preferably a plurality of holding tabs as a strain relief. One holding tab can thus be assigned to one cable and can hold a cable firmly.

The invention claimed is:

1. A plug connector with a housing for receiving at least one electrical cable with at least one electric wire and a sheathing, comprising:

a holding element located on the housing;

a flexible holding tab on the holding element, the holding tab being arranged at an angle to a longitudinal direction of a cable opening, and configured for engagement with the sheathing of the cable wherein the holding element has a catch projection corresponding to a locking piece;

wherein the locking piece has a catch recess, for receiving the catch projection in a rotating position of the locking piece;

wherein the locking piece has a recess for receiving a part of a holder of the housing; and wherein the locking piece is fitted on the holder in a starting position, at least a part of the holder being pushed into the recess, and the locking piece is movable from the starting position into an assembly position by rotation.

2. The plug connector according to claim 1, wherein the holding tab has a first face provided as a mating surface for a surface of the sheathing of the cable and a second face, constructed in one part, the second face being oriented at an angle to the first face.

3. The plug connector according to claim 2, wherein, the second face is inclined in the direction of a central axis of the cable opening.

4. The plug connector according to claim 3, wherein the holding element has two holding tabs that are arranged at an angle around a cable opening.

5. The plug connector according to claim 4, wherein the holding element has a contact face for contacting a shield of the cable.

6. The plug connector according to claim 1, wherein during the rotation, a flexibly mounted catch projection of the holding element passes over a stop face of the locking piece thereby urging the catch projection in a radial direction from a starting position.

7. The plug connector according to claim 6, wherein after the holding element passes over the stop face, the catch projection springs into the starting position and the locking piece is moved into an assembly position.

8. The plug connector according to claim 7, wherein a rotation of the locking piece back from the assembly position into the starting position is blocked by the catch projection, which mates with a catch edge on the stop face and blocks a rotation of the locking piece back into the starting position.

9. The plug connector according to claim 8, wherein the locking piece is pivoted on a second housing part.

10. The plug connector according to claim 9, wherein the first housing part has a holder, which is embraced by the locking piece in the locking position to hold the two housing parts together.

11. The plug connector according to claim 1, wherein the holding element is formed from a metal piece as a bent part.

12. The plug connector according claim 1, wherein the locking piece has a mating surface for a guiding part of the holding element, and the locking piece slides on the guiding part during a rotation with the mating surface and is guided by means of the guiding part.

13. The plug connector according to claim 1, wherein the holding element has a spring arm, and the spring arm is connected to the holding tab.

14. The plug connector according to claim 13, wherein the holding element has a further spring arm, which is connected to the contact face.

15. The plug connector according to claim 14, wherein the first spring arm has a first and a second portion, the first and the second portions being connected via a bent portion with a bend of more than 90°, the first portion being connected to a basic element of the holding element, and the second portion being connected to the holding tab.

16. The plug connector according to claim 15, wherein the further spring arm has a first and a second portion, the first and the second portions being connected via a bent portion with a bend of more than 90°, the first portion being connected to a basic element of the holding element, and the second portion being connected to the contact face.

17. The plug connector according to claim 16, wherein the holding element has a basic element and two holding arms extending out therefrom on opposite sides, the two holding arms being supported on the housing.

18. The plug connector according to claim 17, wherein the holding tab is held flexibly on the housing and projects into the cable opening, such that cables with different diameters can be clamped firmly on the housing with the holding tab.

* * * * *